US006827626B1

(12) United States Patent
Feeney et al.

(10) Patent No.: US 6,827,626 B1
(45) Date of Patent: Dec. 7, 2004

(54) MARIONETTE

(75) Inventors: Mary Jo Feeney, Jamaica Plain, MA (US); Tucker Fort, New York, NY (US); Alexandra Fort, Boston, MA (US)

(73) Assignee: Playstages, Incorporated, Boston, MA (US)

( * ) Notice: Subject to any disclaimer, the term of this patent is extended or adjusted under 35 U.S.C. 154(b) by 0 days.

(21) Appl. No.: 10/375,425

(22) Filed: Feb. 27, 2003

Related U.S. Application Data

(60) Provisional application No. 60/360,430, filed on Feb. 28, 2002.

(51) Int. Cl.[7] ..... A63H 3/20

(52) U.S. Cl. ..... 446/359; 446/366; 446/361

(58) Field of Search ..... 446/330, 359, 446/360, 361, 362, 363, 364, 365, 366, 367, 82, 83, 84

(56) References Cited

U.S. PATENT DOCUMENTS

| | | | | |
|---|---|---|---|---|
| 1,350,711 A | | 8/1920 | Dondo | |
| 1,501,912 A | | 7/1924 | Meehan | |
| 1,721,091 A | * | 7/1929 | Ritchie et al. | 446/363 |
| 1,721,186 A | | 7/1929 | Muller | |
| 1,902,983 A | * | 3/1933 | Adler et al. | 446/363 |
| 1,987,528 A | * | 1/1935 | Fukumoto | 446/363 |
| 2,113,839 A | * | 4/1938 | Hedges | 446/363 |
| 2,466,214 A | | 4/1949 | Deaton | |
| 2,662,338 A | * | 12/1953 | Baird | 446/363 |
| 2,705,850 A | * | 4/1955 | Evans | 446/363 |
| 2,862,331 A | | 12/1958 | Oppenheimer | |
| 4,137,665 A | * | 2/1979 | Bierwiler | 446/83 |
| 4,179,843 A | * | 12/1979 | Ho | 446/363 |
| 5,030,162 A | * | 7/1991 | Hall et al. | 446/363 |
| 5,980,357 A | * | 11/1999 | Newby | 446/366 |

FOREIGN PATENT DOCUMENTS

RU 2102099 C1 * 1/1998 ..... A63H/13/02

OTHER PUBLICATIONS

Hearth Song, Wooden Animal Marionettes, Internet: http: www.hearthsong.com, 2003.*

* cited by examiner

*Primary Examiner*—Derris H. Banks
*Assistant Examiner*—Urszula M Cegielnik
(74) *Attorney, Agent, or Firm*—Mary M. Moyne; Ian C. McLeod

(57) ABSTRACT

A marionette having a controller and a puppet. The controller having a pair of control wings pivotably connected at the second end to one end of a control rod. The other end of the control rod is connected to the puppet. The puppet can have a human form with a head, torso, arms and legs. A pair of control strings extend from the first ends of the control wings to the arms of the puppet. The arms of the puppet are connected to the torso so as to allow a wide range of movement of the arms. The puppet is moved by tilting and pivoting the control wings on the end of the control rod and by moving the control rod.

64 Claims, 7 Drawing Sheets

MARIONETTE

CROSS-REFERENCE TO RELATED APPLICATIONS

This application claims the benefit of U.S. Provisional Application Ser. No. 60/360,430 filed Feb. 28, 2002.

STATEMENT REGARDING FEDERALLY SPONSORED RESEARCH OR DEVELOPMENT

Not Applicable

BACKGROUND OF THE INVENTION (1) Field of the Invention

The present invention relates to a marionette having a controller and a puppet. In particular, the present invention relates to a marionette which is constructed such as to provide a wide range of movement of the puppet by using the controller.

(2) Description of the Related Art

The related art has shown various types of controllers for marionettes. Illustrative are U.S. Pat. No. 1,902,983 to Adler et al; U.S. Pat. No. 1,987,528 to Fukumoto; U.S. Pat. No. 2,862,331 to Oppenheimer; U.S. Pat. No. 5,030,162 to Hall et al and U.S. Pat. No. 5,980,357 to Newby.

Adler et al and Fukumoto both show a toy having a Y-shaped handle which connects to the head and arms of the toy for controlling the movement of the toy.

Oppenheimer shows a marionette having a hook attached to the body of the puppet preferably inside of the neck which allows for moving the puppet. The controller does not attach to the arms of the puppet.

Hall et al shows a marionette comprised of a single three-dimensional object covered by a thin flexible sheet which is connected by a filament to the center of an H-shaped handle member with each corner of the sheet being attached by a small weight which is connected to a filament to an extremity of the handle member.

Newby shows a puppet which includes a head fixed to a control rod, a body suspended by a second rod, forward limbs suspended by the ends of a looped string and rear limbs which dangle from the body. The control rod, second rod and looped string are all connected to a handle. The control rod extends through a slot in the handle and is pivotable about a pin extending transversely through the slot. The control rod is also rotatable about its longitudinal axis. The second rod is pivotable about a pin at the rear end of the handle and is also pivotable at its bottom end by virtue of a bottom eye which is looped through an eye screw in the body. In this invention, the arms of the handle connected to the strings which are connected to the limbs are stationary.

Of some interest are U.S. Pat. No. 1,350,711 to Dondo; U.S. Pat. No. 1,501,912 to Meehan; U.S. Pat. No. 1,721,186 to Muller; U.S. Pat. No. 2,466,214 to Deaton; U.S. Pat. No. 2,705,850 to Evans and U.S. Pat. No. 4,179,843 to Ho which show different types of marionettes.

Therefore, none of the above patents show a controller having wings attached to the puppet and a control rod attached to the puppet where the wings are pivotably connected to the control rod.

There remains the need for a marionette having a controller which is easily maneuvered with one hand and which allows for controlled and varied movement of the puppet.

SUMMARY OF THE INVENTION

A marionette having a puppet and a controller.

In one (1) embodiment, the puppet has a human form with a head, torso, arms and legs. The torso of the puppet adjacent the head has an opening to allow the puppet to be connected to the controller. The arms are connected to the shoulder sockets of the torso so as to allow a wide range of movement of the arms about the shoulder. The arms also have joints to simulate an elbow. The legs are pivotably connected to the bottom of the torso and enable the puppet to be moved into a sitting or standing position. The legs have joints to simulate knees to enable the puppet to kneel. Hands are provided on the arms opposite the shoulders. The fingers of the hand are cupped to form a chamber. The fingers and thumb of the hands are spaced apart to form a slot into the chamber. The controller includes a pair of control wings, a control rod and a pair of control strings. The control wings have first and second ends and are connected together at the second ends. In one (1) embodiment, the control wings are pivotably connected together at the second ends. The control rod has a pivot ball at the first end and a connector at the second end. In one (1) embodiment, the control rod is L-shaped. The second ends of the control wings have openings to accommodate the pivot ball of the control rod. The control strings have first and second ends with balls at each end. The first ends of the control wings have holes to allow for connecting the first ends of the control strings to the control wings. The puppet is connected to the controller by inserting the connector at the second end of the control rod into the opening in the torso of the puppet. The control strings are then connected to the hands of the puppet by slipping the control strings adjacent the second ends through the slots between the finger and thumb of the hands so that the balls at the second ends of the control strings are positioned in the chambers formed by the fingers of the hand.

To move the arms of the puppet, the user pivots and rotates the control wings on the pivot ball of the controller. To move the entire puppet including the head and torso of the puppet, the user rotates the control rod. The ball and socket connection of the control wings and the control rod allows the wings to be moved without moving the control rod and allows the control rod to be moved without moving the wings.

The present invention relates to a marionette which comprises: a controller having a first wing with a first end and a second end and a second wing with a first end and a second end, and having a control rod with a first end and a second end wherein the wings are connected together at the second ends and the control rod is pivotably connected at the first end to the second ends of the first and second wings; a puppet having a head, a torso and appendages with the head fixably mounted on the torso and the appendages movably mounted on the torso wherein a back of the torso adjacent the head has an opening and wherein the second end of the control rod is inserted into the opening to connect the puppet to the controller; and control strings having a first end and a second end and connected at the first end to the first and second wings of the controller and connected at the second end to the appendages of the puppet.

Further, the present invention relates to a controller for a marionette, which comprises: a first wing having a first end and a second end; a second wing having a first end and a second end and connected to the first wing so that the second end of the first wing is adjacent the second end of the second wing; and a control rod having a first end and a second end, with the first end pivotably connected to the second end of the first and second wings and the second end having a connector which is configured to be fixably connected to a puppet of the marionette.

Still further, the present invention relates to a method for controlling a puppet of a marionette, which comprises the steps of: providing a controller having a first wing having a first end and a second end; a second wing having a first end and a second end and configured to be connected to the first wing such that the second end of the first wing is adjacent the second end of the second wing; and a control rod having a first end and a second end and configured to be pivotably connected at the first end to the second end of the first and second wings and having a connector at the second end; providing a puppet having a head fixably mounted on a torso and a pair of arms movably mounted on the torso; providing control strings having a first end and a second end with a ball at each end; connecting the second end of the control rod to the puppet; connecting the first ends of the control strings to the first ends of the first and second wings so that the control strings extend from the first and second wings in a direction toward the puppet; connecting the second ends of the control strings to the pair of arms of the puppet; and pivoting the first and second wings on the control rod so that the first ends of the first and second wings move causing the pair of arms of the puppet to move.

The substance and advantages of the present invention will become increasingly apparent by reference to the following drawings and the description.

DESCRIPTION OF THE PREFERRED EMBODIMENTS

Figure 3:
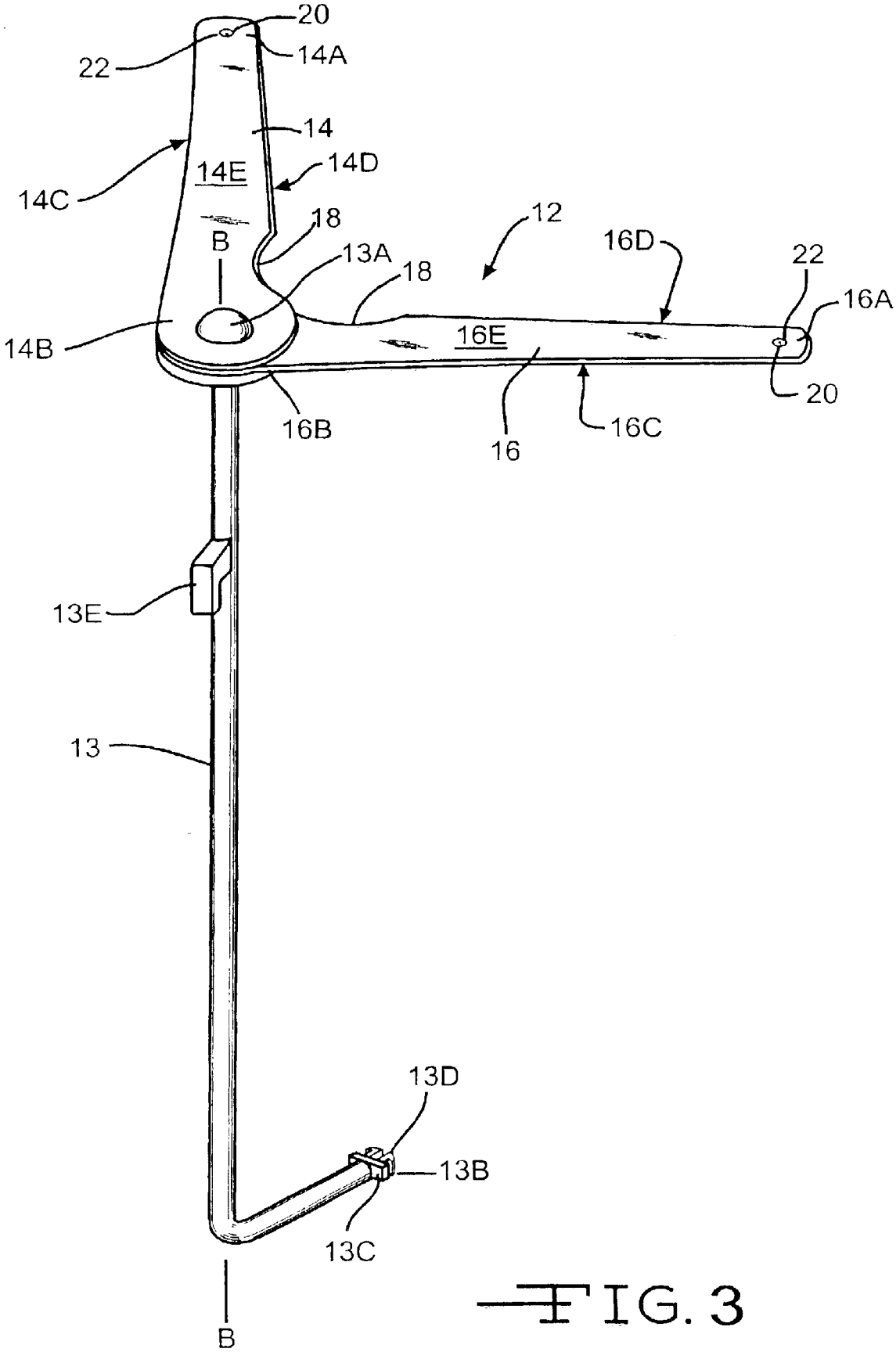
FIG. 3 is a perspective view of the controller 12 without the control strings 42 showing the wings 14 and 16 in the open position.

The marionette 10 of the present invention includes a puppet 50 and a controller 12. The controller 12 includes a control rod 13, control wings 14 and 16 and control strings 42. In one (1) embodiment, the control rod 13 has a cylindrical shape. In one (1) embodiment, the control rod 13 has a pivot ball 13A at the first end and a connector 13B at the second end. In this embodiment, the pivot ball 13A has a spherical shape with a size greater than a size of the control rod 13. The pivot ball 13A preferably has an essentially smooth outer surface to allow for easier rotation in the openings 24 and 26 in the second ends 14B and 16B of the first and second wings 14 and 16. The control rod 13 is L-shaped and is angled so that an angle of essentially 90° is formed in the control rod 13 adjacent the second end and the second end extends part to the first end. The connector 13B, at the second end of the control rod 13, can have a variety of shapes. In one (1) embodiment, the connector 13B includes a base 13C and prongs 13D (FIG. 3). The base 13C is mounted on the second end of the control rod 13 and provides a mounting platform for the prongs 13D. In one (1) embodiment, the base 13C has a rectangular shape with a length greater than a diameter or width of the control rod 13 and has a width essentially equal to the diameter of the control rod 13. The prongs 13D extend outward from the base 13C in a direction away from the second end of the control rod 13. in one (1) embodiment, the connector 13B has two (2) spaced apart prongs 13D. The end of the prongs 13D opposite the base 13C are enlarged and angled to form lips 28A. The prongs 13D are constructed of a resilient material having flex and memory such that the prongs 13D are able to be squeezed or compressed together without breaking. When the squeezing or compression force is removed, the prongs 13D spring hack to their original, normal position and shape. The control rod 13, pivot ball 13A and connector 13B are preferably constructed of a lightweight, durable material such as polycarbonate. In one (1) embodiment, the control rod 13 is transparent. Use of a transparent control rod 13 creates the illusion that the puppet 50 is suspended in air and is moving without assistance. The control rod 13 can also include a hook 13E spaced between the ends of the control rod 13. In one (1) embodiment, the hook 13E is spaced closer to the first end of the control rod 13. The hook 13E allows for securing the controllers 12 in a carrying case (not shown). The hook can also be used to hold the puppet 50 in a standing position without the user 100 having to hold the controller 12.

Figure 4:
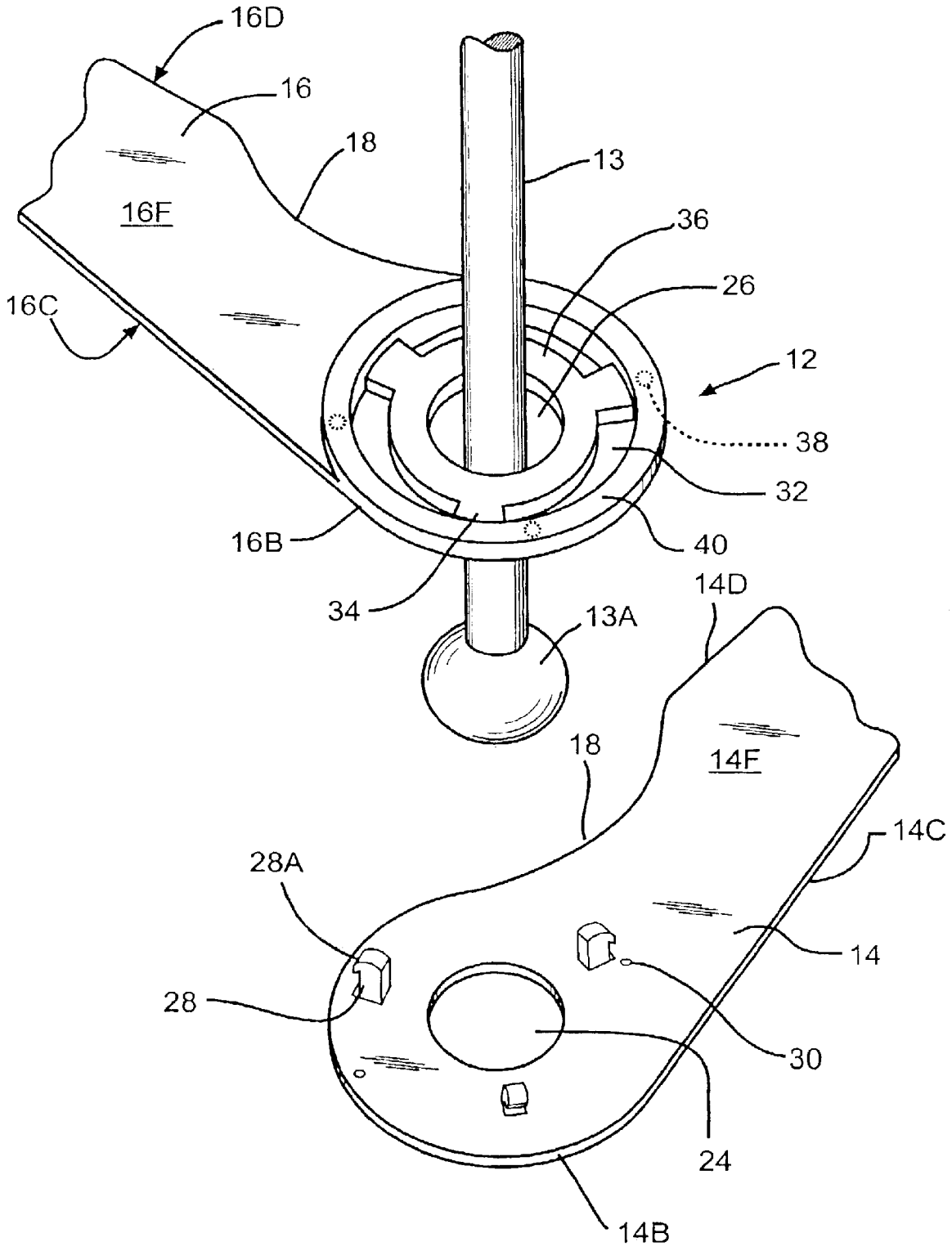
FIG. 4 is an exploded partial bottom view of the controller 12 at the pivot point showing the first wing 14 and the second wing 16 and the pivot ball 13A on the first end of the control rod 13.

In one (1) embodiment, the control wings 14 and 16 include a top or first wing 14 and a bottom or second wing 16. It is understood that the number of control wings 14 and 16 can be adjusted depending on the form of the puppet 50. Additional control wings 14 and 16 used can be increased to match the number of appendages of the puppet 50 which are to be controlled. The control wings 14 and 16 have a first end 14A and 16A and a second end 14B and 16B with a first edge 14C and 16C and a second edge 14D and 16D extending therebetween. The control wings 14 and 16 also have a first surface 14E and 16E and a second surface 14F and 16F extending between the ends 14A, 14B, 16A and 16B. The first and second control wings 14 and 16 preferably have a similar outer shape. In one (1) embodiment, the second edge 14D and 16D of the control wings 14 and 16 includes a rounded or curved indention 18 adjacent the second end 14B and 16B of the control wings 14 and 16. The control wings 14 and 16 have a slightly angled shape such that the second end 14B and 16B is wider than the first end 14A and 16A. In one (1) embodiment, the second end 14B and 16B of the control wings 14 and 16 is curved or rounded and is generally circular. The first end 14A or 16A of each wing 14 or 16 has a hole 20. The hole 20 can be centered in the first end 14A and 16A. The first and second control wings 14 and 16 also have a concave or curved indention 22 in the first surface 14E and 16E surrounding the hole 20 (FIG. 3);

The second ends 14B and 16E of the control wings 14 and 16 have openings 24 and 26 centered in the second end 14B and 16B (FIG. 4). In one (1) embodiment, the openings 24 and 26 are circular. In one (1) embodiment, the opening 24 in the second end 14B of the first control wing 14 is smaller in diameter than the opening 26 in the center of the second end 16B of the second control wing 16. The first control wing 14 has prongs 28 which are spaced around the circumference of the opening 24 on the second end 14B of the first control wing 14. The prongs 28 extend outward from and perpendicular to the second surface 14F of the first control wing 14. Each prong 28 has a lip 28A at the end opposite the second surface 14F of the first control wing 14 on a side opposite the opening 24. In one (1) embodiment, there are three (3) prongs 28 evenly spaced around the circumference of the opening 24. Nubs 30 can also be provided on the second surface 14F of the first control wing 14. The nubs 30 extend outward from the second surface 14F of the first control wing 14. In one (1) embodiment, the nubs 30 have a semi-circular shape. In one (1) embodiment, there are two (2) nubs 30 spaced apart 180° around the circumference of the opening 24. The second control wing 16 has several curved slots 32 located around the perimeter or circumference of the opening 26 in the second end 16B. In one (1) embodiment, there are three (3) slots 32 with stops 34 between each slot 32 and a center ring 36 separating the slots 32 from the opening 26. The first surface 16E of the second control wing 16 is provided with indents 38 spaced apart around the circumference of the circle formed by the outer edge of the curved slots 32. In one (1) embodiment, there are four (4) indents 38. The shape of the indents 38 depends on the shape of the nubs 30 on the first control wing 14. The second end 16B of the second control wing 16 has a ring 40 extending outward from the second surface 16F of the second control wing 16. The ring 40 follows the circumference of the circle formed by the outer edge of the slots 32.

Figure 1:
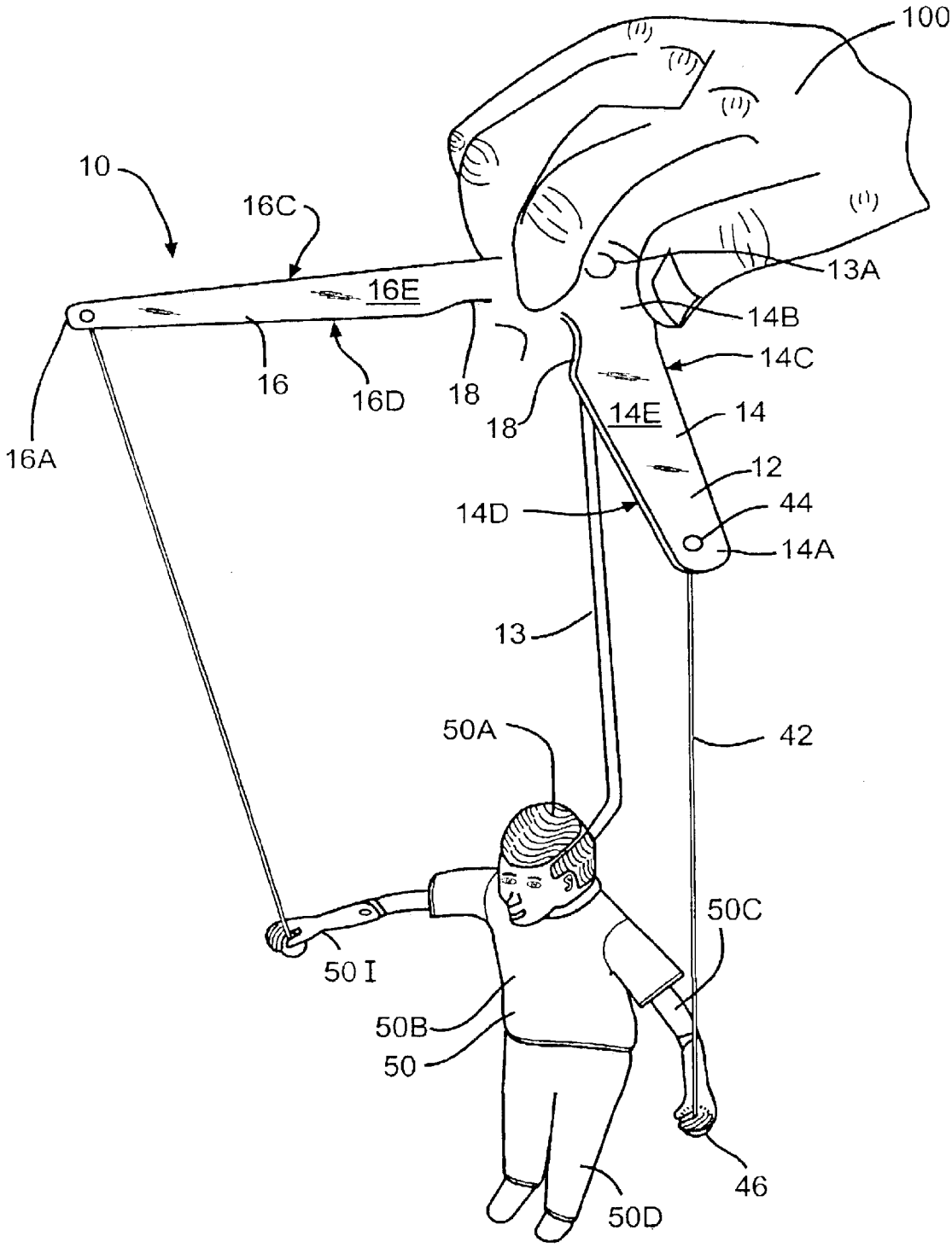
FIG. 1 is a perspective view of the marionette 10 showing the puppet 50 connected to the controller 12 by the control rod 13 and control strings 42 with a user 100 holding the controller 12.

The control strings 42 are preferably identical and have a first end and a second end with first and second balls or spheres 44 and 46 at each end (FIG. 1). The balls 44 and 46 can be mounted on ends of the control strings 42 by any well known means. The control strings 42 extend between the first ends 14A and 16A of the control wings 14 and 16 and the hands 50I of the puppet 50. The first ends of the control strings 42 are movably connected to the first ends 14A and 16A of the first and second control wings 14 and 16. The control strings 42 are connected such that the first balls 44 at the first ends of the control strings 42 are positioned in the curved indentions 22 surrounding the holes 20 in the first ends 14A and 16A of the first and second control wings 14 and 16. In one (1) embodiment, the diameter of the ball 44 is slightly greater than the diameter of the indention 22 so that a majority of the ball 44 protrudes above the indention 22. The shape of the first balls 44 and the shape of the indentions 22 is such that the balls 44 are able to easily pivot in the indentions 22. The control strings 42 extend outward from the first balls 44 through the holes 20 in the first ends 14A and 16A of the first and second control wings 14 and 16 to second balls 46 positioned in the hands 50I of the puppet 50. The size of the second balls 46 is such as to fit closely within the chamber 50L formed by the hands 50I of the puppet 50. To allow for connecting the control strings 42 through the holes 20 in the first ends 14A and 16A of the control wings 14 and 16, one of the balls 44 or 46 is mounted on the end of the control string 42 after the control string 42 is passed through the hole 20 on the first end 14A or 16A of the control wing 14 or 16. The control strings 42 can be constructed of any well known flexible and durable material such as Nylon®.

Figure 2:
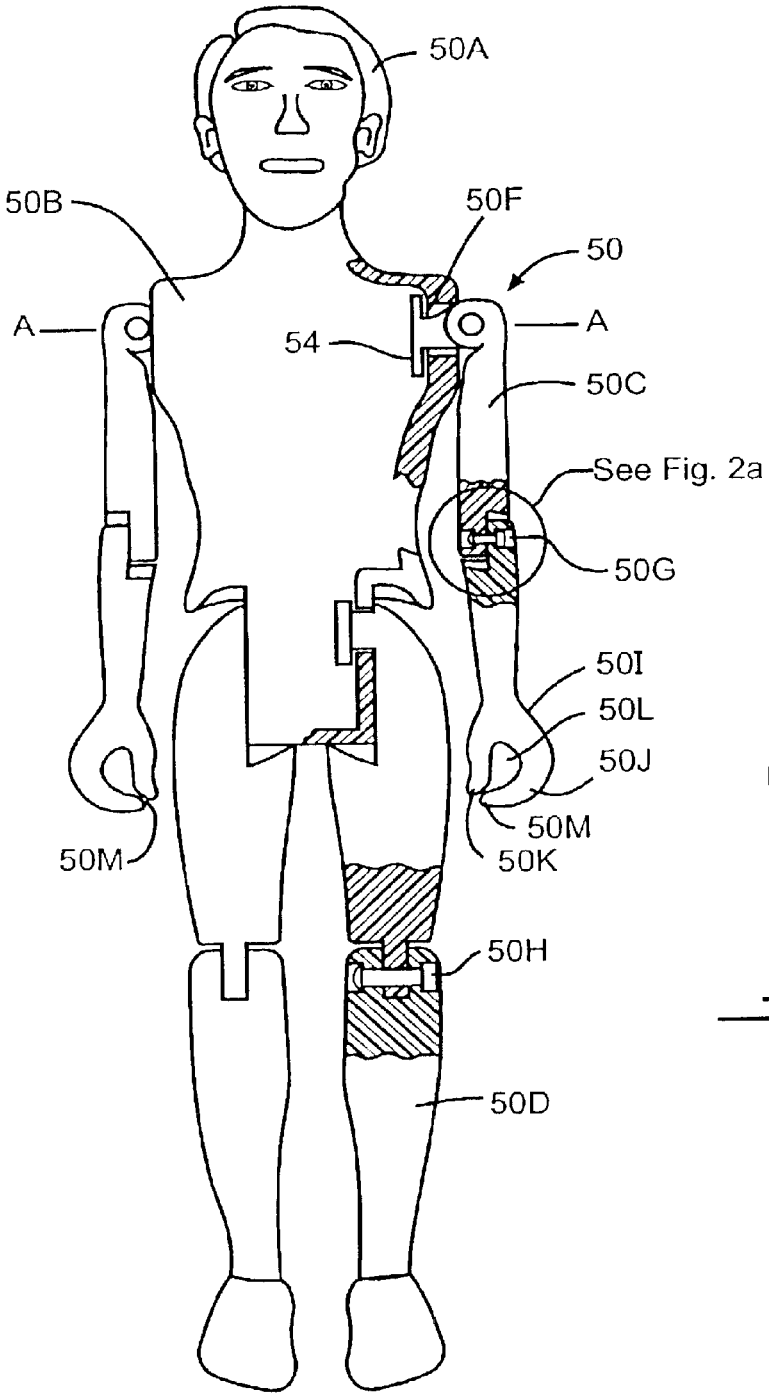
FIG. 2 is a front view of a puppet 50 of one (1) embodiment having a partial cross-sectional view of the lower torso 50B with the legs 50D in elevation showing the connection of the legs 50D to the torso 50B and having a partial cross-sectional view of the shoulder 50F with the arms 50C in elevation showing the connection of the arms 50C to the torso 50B and having a partial cross-sectional view of the joint forming the knee 50H.
Figure 5:
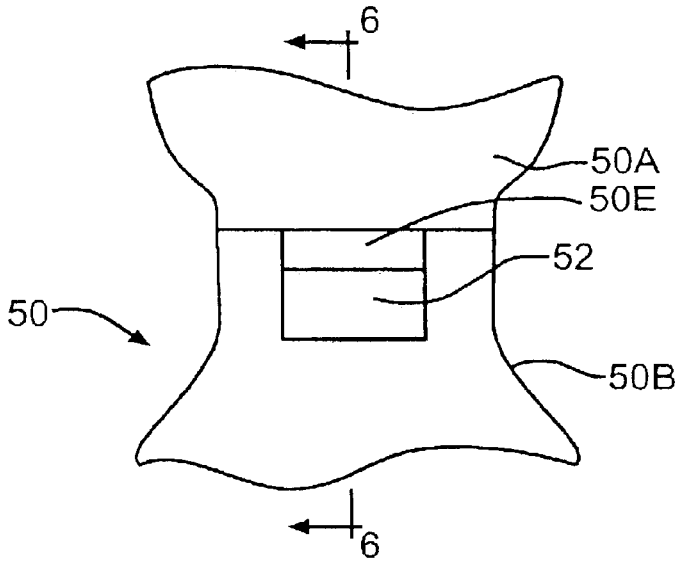
FIG. 5 is a partial back view of the puppet 50 showing the opening 52 in the torso 50B adjacent the head 50A.
Figure 6:
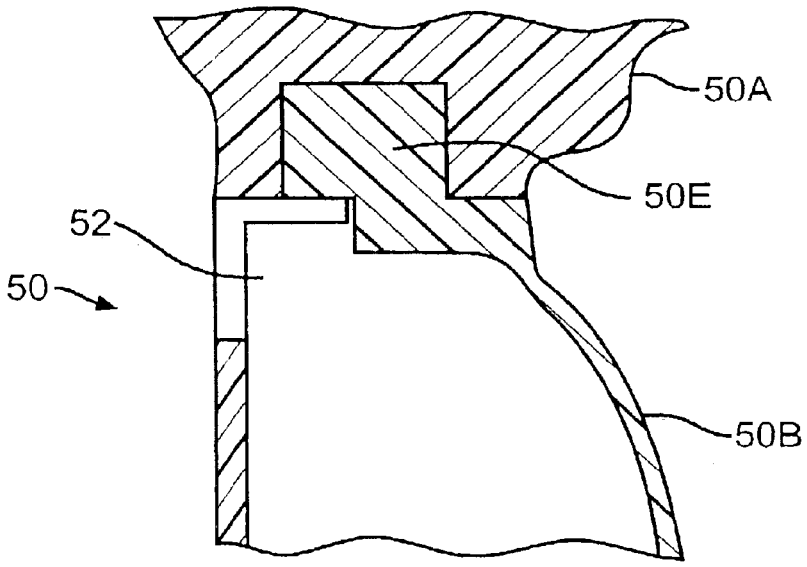
FIG. 6 is a cross-sectional view of the upper torso 50B and head 50A of the puppet 50 showing the opening 52.

It is understood that the puppet 50 could have any well known form such as animals, humans or fantasy figures such as dragons. The puppet 50 could be of any size so as to represent children and adults. In one (1) embodiment, the size of the controller 12 is varied depending on the size of the puppet 50. In one (1) embodiment, the puppet 50 has a head 50A, a body or torso 50B and appendages. In one (1) embodiment, the puppet 50 has a human form and the appendages are a pair of arms 50C and a pair of legs 50D (FIG. 2). The head 50A is fixably attached to the torso 50B (FIG. 6). In one (1) embodiment, the torso 50B of the puppet 50 is hollow. The back of the body or torso 50B adjacent the head 50A has a squared notch. When the head 50A is connected to the torso 50B, the bottom edge of the head 50A at the back of the head 50A closes off the top of the notch such that an opening 52 is formed in the torso 50B (FIG. 5). The shape of the opening 52 depends on the shape of the connector 13B on the end of the control rod 13. An extension 50E extending upward from the torso 50B extends into an opening in the base 13C of the head 50A and allows for mounting the head 50A on the torso 50B (FIG. 6). The extension 50B extends downward and is visible through the opening 52 and provides an inner stop 34 for, the opening 52.

Figure 2A:
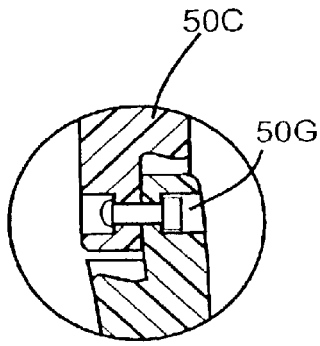
FIG. 2A is an enlarged portion of FIG. 2 showing the joint forming the elbow 50G of the puppet 50.
Figure 7:
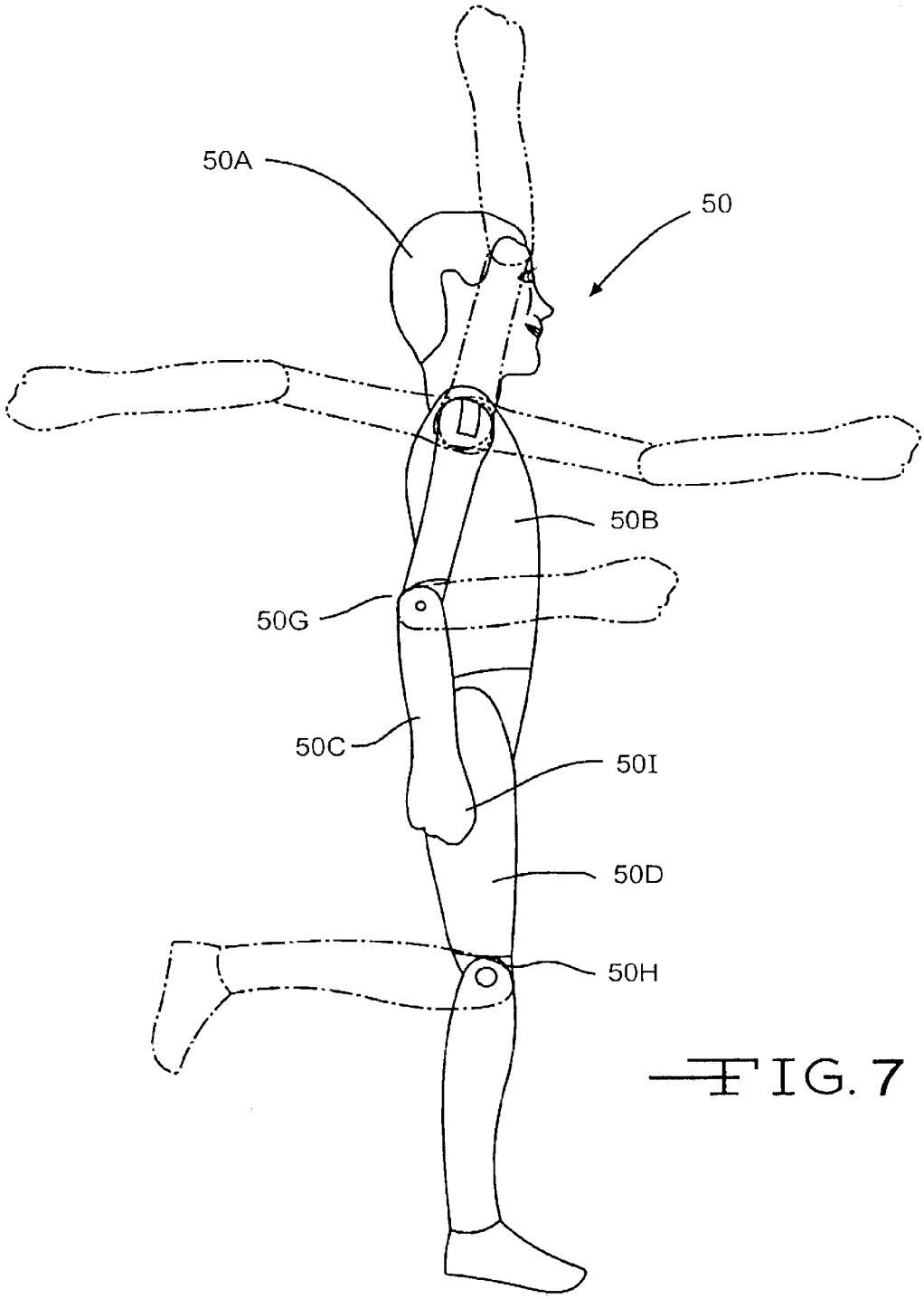
FIG. 7 is a side view of the puppet 50 showing the direction of movement of the arms 50C and the legs 50D.

The arms 50C of the puppet 50 are pivotably and rotatably connected to the body or torso 50B. The arms 50C are connected using a connection which allows for 360° rotation of the arm 50C (FIGS. 2 and 7). The end of each arm 50C opposite the hand 50I is pivotably connected to a socket connector 54 which is positioned in the shoulder socket 50F of the torso 50B. The pivotable connection of each arm 50C to the socket connector 54 allows for up and down movement of the arm 50C (FIG. 7). The positioning of the socket connector 54 in the shoulder socket 50F allows for 360° rotation of the arm 50C around a horizontal axis A-A (FIG. 7) and to extend outward along or parallel to the horizontal axis A-A. Thus, the arms 50C are able to extend outward perpendicular to the parallel planes formed by the front and back sides of the torso 50B. The legs 50D of the puppet 50 are pivotably connected to the bottom end of the torso 50B. In one (1) embodiment, the bottom of the torso 50B and the buttocks and hips of the puppet 50 are shaped to enable the puppet 50 to remain in a sitting position when the controller 12 is not attached to the puppet 50. The legs 50D are connected so as to be able to be pivotably 90° in the forward direction such as to enable the puppet 50 to sit and stand. The arms 50C and legs 50D of the puppet 50 are preferably jointed such as to resemble elbows 50G (FIG. 2A) and knees 50H (FIG. 2), respectively. The elbow and knee joints 50G and 50H allow for essentially 90° bending of the arms 50C and legs 50D at the elbows and knees 50G and 50H. The knee joints 50H are constructed such that a greater amount of force is required to bend the lower portion of the leg 50B forward in an unnatural, inhuman way than is required to bend the knee to move the lower portion of the leg 50D backward as with the normal human bending of a knee. The ends of the arms 50C opposite the torso 50B are provided with hands 50I having fingers 50J. The fingers 50J of the hands 50I are curved or cupped to form a curved chamber 50L located adjacent the palms of the hands 50I of the puppets 50. The thumb 50K and first finger 50J of the hands 50I form an opening to the curved chamber 50L and are spaced apart such as to form a slot 50M.

To construct or assemble the controller 12, the first end of the control rod 13 is inserted through the opening 26 in the second end 16B of the second control wing 16. The control rod 13 is pulled through the opening 26 until the pivot ball 13A at the second end of the control rod 13 is in the opening 26 of the second control wing 16 and extends above the first surface 16E of the second control wing 16. The size or diameter of the pivot ball 13A is slightly greater than the size or diameter of the opening 26 such that the pivot ball 13A extends partially through the opening 26 but can not extend completely through the opening 26. The first control wing 14 is then connected to the second control wing 16 by inserting the prongs 28 of the first control wing 14 into the slots 32 of the second control wing 16. The control wings 14 and 16 are mounted together at the second end 14B and 16B with the second surface 14F of the first control wing 14 adjacent the first surface 16E of the second control wing 16. The first and second control wings 14 and 16 are connected together so that the opening 24 in the second end 14B of the first control wing 14 is coaxial with the opening 26 in the second end 16B of the second control wing 16. The positioning of the prongs 28 and the thickness of the lip 28A of the prongs 28, enables the lips 28A to extend over and lock on the ring 40 on the second surface 16F of the second control wing 16 adjacent the slots 32. When the first and second control wings 14 and 16 are secured together, the pivot ball 13A on the end of the control rod 13 extends partially through and above the opening 24 in the second end 14B of the first control wing 14 and partially through and below the opening 26 in the second end 16B of the second control wing 16. The control strings 42 are then connected to the first ends 14A and 16A of the first and second control wings 14 and 16. However, it is understood that the control strings 42 can be connected to the control wings 14 and 16 at any time prior to use. The controller 12 can be easily assembled and disassembled into several parts without damaging any of the parts. Easy assembly and disassembly allows for easy storage of the controller 12. It also enables the various parts of the controller 12 to be quickly and easily replaced if the parts become damaged.

To attach the controller 12 to the puppet 50, the connector 13B at the first end of the control rod 13 is inserted into the opening 52 in the back of the torso 50B of the puppet 50. In one (1) embodiment, the connector 13B snaps into the opening 52 by initially squeezing the prongs 13D together. The hollow nature of the torso 50B allows the prongs 13D to spring back to their original position once the connector 13B is completely inserted into the opening so that the lips on the end of the prongs 13D lock into place along the edge of the opening 52. The base 13C of the connector 13B prevents the connector 13B from being inserted too far into the opening 52. The extension 50E in the interior of the opening 52 also prevents the connector 13B from being inserted too far into the opening 52. Once the puppet 50 is attached to the control rod 13, the control strings 42 are extended from the first ends 14A and 16A of the control wings 14 and 16 to the hands 50I of the puppet 50. The slot 50M between the fingers 50J and thumb 50K allow for inserting the control strings 42 into the hands 50I and the second balls at the second ends of the control strings 42 into the chambers 50L formed by the fingers 50J of the hands 50I. Thus, the control strings 42 extend from the first balls 44 at the first ends 14A or 16A of the control wing 14 or 16, through the holes 20 in the control wings 14 or 16 to the second balls 46 positioned in the hands 50I of the puppet 50. The positioning of the control strings 42 on the control wings 14 and 16 reduces the likelihood that the control strings 42 will become tangled during operation of the marionette 10. In addition, the ability to easily remove the control strings 42 from the hands 50I and arms 50C of the puppet 50 allows the control strings 42 to be easily untangled if they become tangled. The length of the control strings 42 between the balls 44 and 46 depends on the length of the control rod 13 between the ends. In one (1) embodiment, the length of the control strings 42 between the balls 44 and 46 is such that when the puppet 50 is connected to the control rod 13 and the control strings 42 are connected between the control wings 14 and 16 and the arms 50C of the puppet 50 and the control wings 14 and 16 are essentially perpendicular to the control rod 13, the arms 50C of the puppet 50 are essentially at a midway point of the torso 50B or are essentially at the waistline of the puppet 50.

Figure 8:
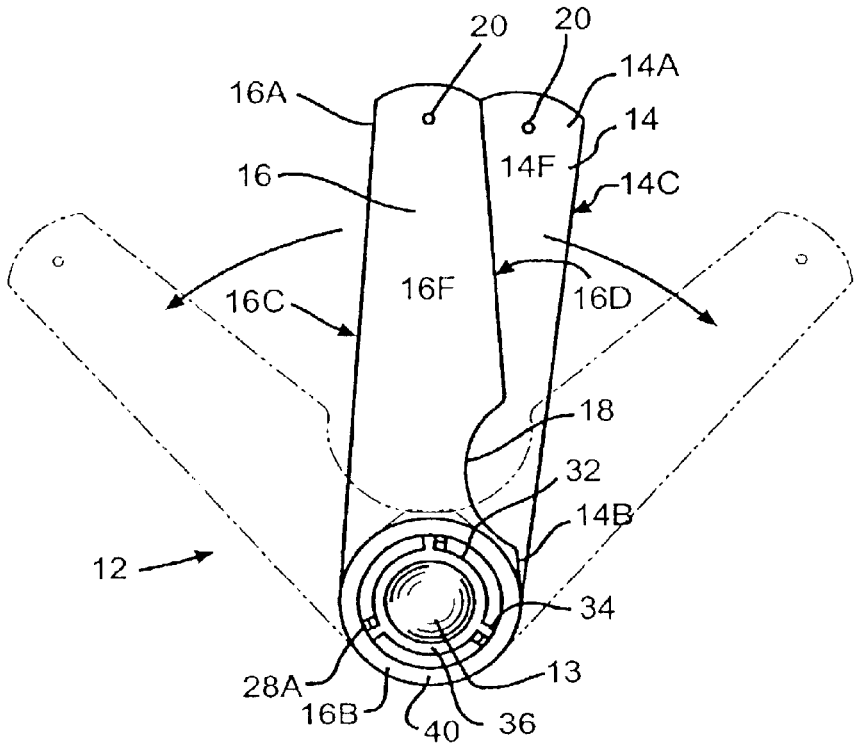
FIG. 8 is a partial bottom view of the controller 12 showing the first and second wings 14 and 16 in the fully closed position and showing the first and second wings 14 and 16 in the fully open position in phantom.
Figure 9:
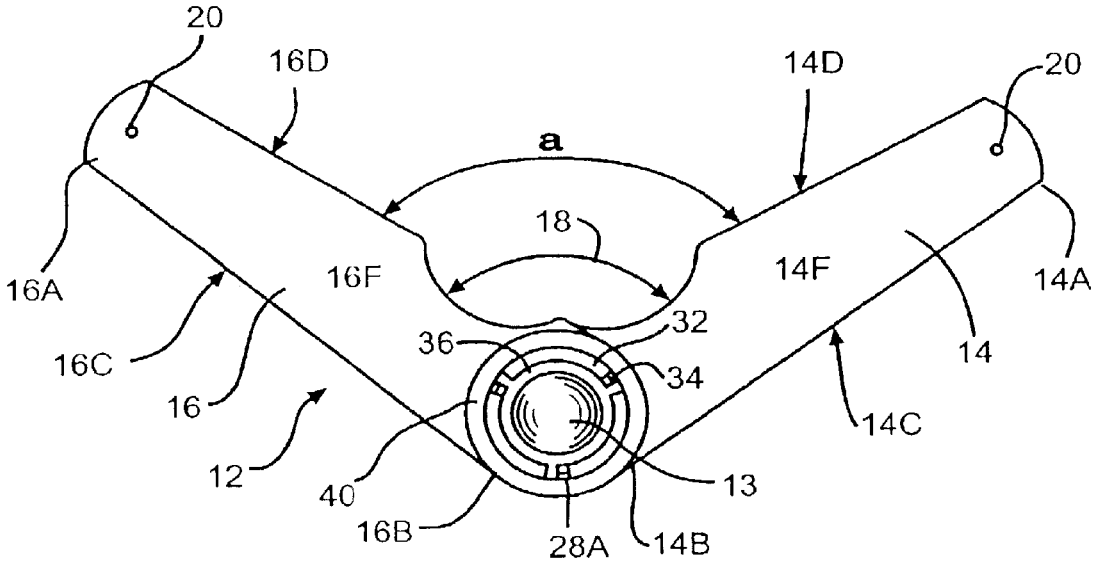
FIG. 9 is a partial bottom view of the controller 12 showing the first and second wings 14 and 16 in the fully open position.

To operate the marionette 10, the control wings 14 and 16 are moved to the open position. In the closed position, the first ends 14A and 16A of the control wings 14 and 16 overlap and the first edge 14C of the first control wing 14 is essentially adjacent the second edge 16D of the second control wing 16 and the second edge 14D of the first control wing 14 is essentially adjacent the first edge 16D of the second control wing 16 (FIG. 8). In the open position, the first ends 14A and 16A of the control wings 14 and 16 are spaced apart so that the angle $\alpha$ between the second edge 14D of the first control wing 14 and the second edge 16D of the second control wing 16 is less than 90° (FIG. 9). As the control wings 14 and 16 are moved from the closed to the open position, the prongs 28 at the second end 14B of the first control wing 14 move along the slots 32 at the second end 16B of the second control wing 16. In the fully closed position, each of the prongs 28 is adjacent one (1) of the stops 34. In the fully open position, each of the prongs 28 is adjacent a different stop 34. In one (1) embodiment as the control wings 14 and 16 are moved to the open position, the prongs 28 move in the slots 32 in the clockwise direction (when viewed from below) to the adjacent stop 34 (FIG. 8). The control wings 14 and 16 are in the fully open position when the prongs 28 contact a stop 34. When the control wings 14 and 16 are in the fully open or fully closed position, each of the nubs 30 of the first control wing 14 is in one (1) of the indents 38 in the second control wing 16. The nubs 30 and indents 38 help to lock or snap the control wings 14 and 16 in the fully open or fully closed position. In general, for easier storage, the control wings 14 and 16 are pivoted to the fully closed position when not in use.

Once the control wings 14 and 16 are in the open position, the user 100 then grasps the control wings 14 and 16 at the pivot point adjacent the pivot ball 13A at the second ends 14B and 16B of the control wings 14 and 16 (FIG. 1). The control wings 14 and 16 are grasped adjacent the pivot point such that at least one (1) finger or thumb of the user 100 is adjacent the first edge 14C or 16C of one (1) of the control wings 14 or 16 and at least one (1) finger or thumb of the user 100 is adjacent the second edge 14D or 16D of the control wings 14 and 16 in the rounded or curved indention 18. In one (1) embodiment, the user 100 grasps the controller 12 so that the second surfaces 14F and 16F of the control wings 14 and 16 are facing away from the user's hand and the control rod 13 and puppet 50 are on a side of the control wings 14 and 16 opposite the user's hand. The user 100 grasps the controller 12 in his right hand so that the thumb of the user 100 is adjacent the second end 14B of the first control wing 14 along the first edge 14C of the first control wing 14. An index finger of the user 100 is positioned at the pivot point of the two (2) control wings 14 and 16 in the curved indentions 18 in the second edges 14D and 16D of the first and second control wings 14 and 16. The user 100 also places at least one (1) finger at the second end 16B of the second control wing 16 along the first edge 16C of the second control wing 16. The user 100 would grasp the controller 12 similarly if using his left hand. To move the hands 50I and arms 50C of the puppet 50, the user 100 tilts and moves the control wings 14 and 16 on the pivot ball 13A of the control rod 13. The control rod 13 is essentially rigid which allows for holding the head 50A and the torso 50B of the puppet 50 still by holding the control rod 13 still and which allows for rotating the head 50A and torso 50B of the puppet 50 by rotating the control rod 13. The ball and socket mounting of the control rod 13 to the control wings 14 and 16 allows the control rod 13 to remain stationary while the control wings 14 and 16 are moved in any direction. Thus, a user 100 can move the arms 50C of the puppet 50 without moving the torso 50B, head 50A and legs 50D of the puppet 50. To move the torso 50B and legs 50D of the puppet 50, so as to make the puppet sit, stand and kneel, the user 100 moves the control rod 13 up and down. The movable mounting of the arms 50C in the shoulder sockets 50F and the elbow joints 50G of the arms 50C allow the arms 50C to move easily in a variety of directions in response to the movement of the control wings 14 and 16. The user 100 can also rotate the control rod 13 along the longitudinal axis B-B of the control rod 13. This allows for rotating the entire puppet 50. In one (1) embodiment, the control rod 13 is cylindrical to allow for easier rotation by the user 100. The control wings 14 and 16 can be moved up and down either together or separately to move the arms simultaneously or separately at both the shoulders and the elbows. By moving the control rod 13 in a forward and downward direction, the knees of the puppet 50 can be bent to move the puppet 50 into a kneeling position. By moving the control rod 13 in a backward and downward direction, the knees and the hip joints or legs of the puppet 50 bend which moves the puppet 50 into a sitting position. The user 100 can also grasp the control wings 14 and 16 and move the control wings 14 and 16 in a back and forth swaying motion to simulate the puppet 50 flying. In one (1) embodiment, due to the construction of the puppet 50, the puppet 50 can also be used as a stand alone figure without the controller 12. In this embodiment, the puppet 50 is able to sit without the controller 12 being connected to the puppet 50.

It is intended that the foregoing description be only illustrative of the present invention and that the present invention be limited only by the hereinafter appended claims.

We claim:

1. A marionette which comprises:

(a) a controller having a first wing with a first end and a second end and a second wing with a first end and a second end, and having a control rod with a first end and a second end with a pivot ball on the first end wherein the second end of the first wing has an opening and the second end of the second wing has an opening and wherein the wings are connected together at the second ends so that the openings are coaxial and the pivot ball of the control rod is pivotably positioned in the openings at the second ends of the first and second wings;

(b) a puppet having a head, a body and appendages with the head fixably mounted on the body and the appendages movably mounted on the body wherein a back of the body adjacent the head has an opening and wherein the second end of the control rod is inserted into the opening to connect the puppet to the controller; and (c) control strings having a first end and a second end and connected at the first end to the first and second wings of the controller and connected at the second end to the appendages of the puppet.

2. The marionette of claim 1 wherein the control rod has an L-shape so that the second end of the control rod extends perpendicular to the first end of the control rod.

3. The marionette of claim 1 wherein the openings and the pivot ball have a size so that when the first and second wings are connected together, the pivot ball extends partially through the opening in the second end of the first wing and partially through the opening in the second end of the second wing.

4. The marionette of claim 3 wherein the control rod is positioned such that the control rod extends outward from the pivot ball through the opening in the second end of the second wing to the second end of the control rod and the puppet.

5. The marionette of claim 1 wherein a hole is provided in each of the first ends of the first and second wings.

6. The marionette of claim 5 wherein the first and second wings have first and second surfaces extending between the first and second ends, wherein a first curved indention is provided in the first surface of the first wing at the first end around the hole and a second curved indention is provided in the first surface of the second wing at the first end around the hole, and wherein the first end of the control strings are provided with first balls and are permanently connected to the first ends of the first and second wings through the holes so that the first balls at the first end of the control strings are movably positioned in the first and second curved indentions on the first surface of the first and second wings respectively.

7. The marionette of claim 1 wherein the first and second wings have first and second surfaces extending between the first and second ends wherein the second end of the first wing has prongs which extend outward from the second surface of the first wing in a direction opposite the first surface of the first wing, wherein the second end of the second wing has curved slots around a perimeter of the second end of the second wing and wherein the first and second wings are connected together so that the second surface of the first wing is adjacent the first surface of the second wing and the prongs extend through the slots to secure the first and second wings together.

8. The marionette of claim 1 wherein the first and second wings have first and second edges extending between the first and second ends and wherein a curved indention is provided in the second edges of the first and second wings adjacent the second ends of the wings.

9. The marionette of claim 1 wherein the first and second wings have first and second edges extending between the first and second ends, wherein the first and second wings are connected together so that in an open position the second edge of the first wing is adjacent the second edge of the second wing and an angle between the second edge of the first wing and the second edge of the second wing is less than 90°.

10. The marionette of claim 1 wherein the first and second wings are pivotably connected together to enable the wings to move between an open position and a closed position and wherein the first wing is provided with nubs and the second wing has indents and wherein the nubs engage the indents to secure the wings in the open or closed position.

11. The marionette of claim 1 wherein the appendages are a pair of arms which are movably mounted on the body so that the pair of arms can rotate 360° about a horizontal axis through a shoulder of the puppet.

12. A controller for a marionette, which comprises:

(a) a first wing having a first end and a second end, the second end having an opening;

(b) a second wing having a first end and a second end, the second end having an opening and connected to the first wing so that the opening in the second end of the first wing is coaxial with the opening in the second end of the second wing; and (c) a control rod having a first end and a second end, with the first end having a pivot ball pivotably positioned in the openings in the second end of the first and second wings and the second end having a connector which is configured to be fixably connected to a puppet of the marionette.

13. The controller of claim 12 wherein the openings have a size less than a size of the pivot ball so that the pivot ball can not extend completely through the openings.

14. The controller of claim 13 wherein the openings and the pivot ball have a size so that when the first and second wings are connected together, the pivot ball extends partially through the opening in the second end of the first wing and partially through the opening in the second end of the second wing.

15. The controller of claim 12 wherein the control rod is positioned such that the control rod extends outward from the pivot ball through the opening in the second end of the second wing to the connector at the second end of the control rod.

16. The controller of claim 12 wherein the openings are positioned in a center of the second end of the first and second wings.

17. The controller of claim 12 wherein the first and second wings have first and second edges extending between the first and second ends and wherein a curved indention is provided in the second edges of the first and second wings adjacent the second ends of the first and second wings.

18. The controller of claim 12 wherein the first and second wings have first and second edges extending between the first and second ends, wherein the first and second wings are connected together so that in an open position the second edge of the first wing is adjacent the second edge of the second wing and an angle between the second edge of the first wing and the second edge of the second wing is approximately less than 90°.

19. The controller of claim 12 wherein a hole is provided in each of the first ends of the first and second wings.

20. The controller of claim 12 wherein the first and second wings have first and second surfaces extending between the first and second ends and wherein the first and second wings are connected together such that the second surface of the first wing is adjacent the first surface of the second wing.

21. The controller of claim 20 wherein the second end of the first wing has prongs which extend outward from the second surface of the first wing in a direction opposite the first surface of the first wing, wherein the second end of the second wing has curved slots around a perimeter of the second end of the second wing and wherein when the first and second wings are connected together, the prongs extend through the slots to secure the first and second wings together.

22. The controller of claim 20 wherein the first ends of the first and second wings have holes, wherein a curved indention is provided in the first surface of the first wing around the hole and in the first surface of the second wing around the hole, wherein a pair of control strings are provided having a first end and a second end with balls at each of the first and second ends, wherein the first end of the control strings are permanently connected to the first ends of the wings through the holes so that the balls at the first end of the control strings are movably positioned in the curved indentions on the first surface of the first and second wings and wherein the second ends of the control strings are connected to arms of the puppet.

23. The controller of claim 12 wherein the second ends of the first and second wings have a size greater than a size of the first ends of the first and second wings.

24. The controller of claim 12 wherein the control rod has an L-shape so that the second end of the control rod extends perpendicular to the first end of the control rod.

25. The controller of claim 12 wherein the first wing and the second wing are pivotably connected together to enable the wings to be moved between an open position and a closed position.

26. The controller of claim 25 wherein the first wing is provided with nubs and wherein the second wing is provided with indents and wherein the nubs engage the indents to secure the wings in the open or closed position.

27. A method for controlling a puppet of a marionette, which comprises the steps of:

(a) providing a controller having a first wing having a first end and a second end; a second wing having a first end and a second end and configured to be connected to the first wing such that the second end of the first wing is adjacent the second end of the second wing; and a control rod having a first end and a second end and configured to be pivotably connected at the first end to the second end of the first and second wings and having a connector at the second end;

(b) providing a puppet having a head fixably mounted on a body and a pair of arms movably mounted on the body, each of the arms having a hand with fingers at an end opposite the body, the fingers positioned to form a chamber having an opening with a slot;

(c) providing control strings having a first end and a second end with a ball at each end;

(d) connecting the second end of the control rod to the puppet;

(e) connecting the first ends of the control strings to the first ends of the first and second wings so that the control strings extend from the first and second wings in a direction toward the puppet;

(f) connecting the second ends of the control strings to the hands of the pair of arms of the puppet by slipping the control strings through the slots so that the balls are positioned in the chamber formed by the fingers; and (g) pivoting the first and second wings on the control rod so that the first ends of the first and second wings move causing the pair of arms of the puppet to move.

28. The method of claim 27 wherein a back side of the body has an opening adjacent a back of the head and the second end of the control rod has a connector and wherein in step (d), the connector is inserted into the opening in the body.

29. The method of claim 27 wherein the first ends of the first and second wings have holes with a curved indention on a side opposite the puppet when the puppet is connected to the control rod, wherein in step (e), the balls at the first ends of the control strings are positioned in the curved indentions so that the control strings extend through the holes toward the puppet and so that the balls are able to pivot in the curved indentions.

30. The method of claim 29 wherein in step (e), the first end of the control strings are permanently connected to the first ends of the wings.

31. The method of claim 27 wherein in step (f), the second end of the control strings are removably connected to the hands of the arms of the puppet.

32. The method of claim 27 wherein in step (g), the control rod is held steady and the head of the puppet does not move.

33. The method of claim 27 wherein in step (g), the control rod is rotated to rotate the puppet.

34. The method of claim 27 wherein in step (g), the first and second wings are moved so that the arms move in a direction along a longitudinal axis of the body of the puppet.

35. The method of claim 27 wherein in step (g), the first and second wings are moved so that the arms move toward or away from the body.

36. The method of claim 27 wherein before step (g), a user grasps the controller so that a user's hand is positioned at the second ends of the first and second wings adjacent the second end of the control rod.

37. The method of claim 27 wherein the first and second wings have first and second edges extending between the first and second ends and wherein in step (g), the user grasps the controller so that at least one finger of the user is adjacent the first edges of the first and second wings and at least one finger of the user is adjacent the second edges of the first and second wings.

38. The method of claim 37 wherein the second edges of the first and second wings adjacent the second ends have curved indentions and wherein in step (g), the user positions at least one finger in the curved indentions.

39. The method of claim 27 wherein the first and second wings have first and second edges extending between the first and second ends and wherein before step (e), the controller is moved to an open position with the first ends of the first and second wings spaced apart so that an angle of less than 90° is formed between the first edges of the first and second wings.

40. The method of claim 27 wherein the first and second wings have openings in the second ends and have first and second surfaces extending between the first and second ends wherein the second end of the first wing has prongs which extend outward from the second surface of the first wing in a direction opposite the first surface of the first wing, wherein the second end of the second wing has curved slots, wherein the control rod has a pivot ball at one end, wherein prior to step (d), the controller is assembled by inserting the control rod through the opening in the second wing such that the pivot ball on the end of the control rod is in the opening of the second wing and by connecting the first and second wings together by inserting the prongs through the slots so that the pivot ball of the control rod is in the openings of the first and second wings and so that the second surface of the first wing is adjacent the first surface of the second wing.

41. A marionette which comprises:

(a) a controller having a first wing with a first end and a second end and a second wing with a first end and a second end, and having a control rod with a first end and a second end, the second end having a connector with spaced apart prongs which are flexible wherein the wings are connected together at the second ends and the control rod is pivotably connected at the first end to the second ends of the first and second wings;

(b) a puppet having a head, a body and appendages with the head fixably mounted on the body and the appendages movably mounted on the body, wherein a back of the body adjacent the head has an opening, wherein the connector at the second end of the control rod is inserted into the opening so that the prongs compress together and wherein when the connector is fully in the opening in the back of the body, the prongs spring back to a normal position to lock the connector in the body; and (c) control strings having a first end and a second end and connected at the first end to the first and second wings of the controller and connected at the second end to the appendages of the puppet.

42. The marionette of claim 41 wherein a hole is provided in each of the first ends of the first and second wings and the first and second wings have first and second surfaces extending between the first and second ends, wherein a first curved indention is provided in the first surface of the first wing at the first end around the hole and a second curved indention is provided in the first surface of the second wing at the first end around the hole, and wherein the first end of the control strings are provided with first balls and are permanently connected to the first ends of the first and second wings through the holes so that the first balls at the first end of the control strings are movably positioned in the first and second curved indentions on the first surface of the first and second wings respectively.

43. The marionette of claim 41 wherein the first and second wings have first and second surfaces extending between the first and second ends wherein the second end of the first wing has prongs which extend outward from the second surface of the first wing in a direction opposite the first surface of the first wing, wherein the second end of the second wing has curved slots around a perimeter of the second end of the second wing and wherein the first and second wings are connected together so that the second surface of the first wing is adjacent the first surface of the second wing and the prongs extend through the slots to secure the first and second wings together.

44. The marionette of claim 41 wherein the first and second wings have first and second edges extending between the first and second ends and wherein a curved indention is provided in the second edges of the first and second wings adjacent the second ends of the wings.

45. The marionette of claim 41 wherein the first and second wings have first and second edges extending between the first and second ends, wherein the first and second wings are connected together so that in an open position, the second edge of the first wing is adjacent the second edge of the second wing and an angle between the second edge of the first wing and the second edge of the second wing is less than 90°.

46. The marionette of claim 41 wherein the first and second wings are pivotably connected together to enable the wings to move between an open position and a closed position and wherein the first wing is provided with nubs and the second wing has indents and wherein the nubs engage the indents to secure the wings in the open or closed position.

47. The marionette of claim 41 wherein the appendages are arms which are movably mounted on the body so that the arms can rotate 360° about a horizontal axis through a shoulder of the puppet.

48. A marionette which comprises:

(a) a controller having a first wing with a first end and a second end and a second wing with a first end and a second end, and having a control rod with a first end and a second end wherein the wings are connected together at the second ends and the control rod is pivotably connected at the first end to the second ends of the first and second wings;

(b) a puppet having a head, a body and arms having hands with fingers with the hands positioned so that the fingers form a chamber with an opening having a slot, with the head fixably mounted on the body and the arms movably mounted on the body wherein a back of the body adjacent the head has an opening and wherein the second end of the control rod is inserted into the opening to connect the puppet to the controller; and (c) control strings having a first end and a second end and connected at the first end to the first and second wings of the controller, the second end having a ball and configured to be moved through the slot into the opening of the hand so that the balls are positioned in the chambers of the hands and the control strings extend through the openings to the first ends of the control strings and the first and second wings of the controller.

49. The marionette of claim 48 wherein a hole is provided in each of the first ends of the first and second wings and the first and second wings have first and second surfaces extending between the first and second ends, wherein a first curved indention is provided in the first surface of the first wing at the first end around the hole and a second curved indention is provided in the first surface of the second wing at the first end around the hole, and wherein the first end of the control strings are provided with first balls and are permanently connected to the first ends of the first and second wings through the holes so that the first balls at the first end of the control strings are movably positioned in the first and second curved indentions on the first surface of the first and second wings respectively.

50. The marionette of claim 48 wherein the first and second wings have first and second surfaces extending between the first and second ends wherein the second end of the first wing has prongs which extend outward from the second surface of the first wing in a direction opposite the first surface of the first wing, wherein the second end of the second wing has curved slots around a perimeter of the second end of the second wing and wherein the first and second wings are connected together so that the second surface of the first wing is adjacent the first surface of the second wing and the prongs extend through the slots to secure the first and second wings together.

51. The marionette of claim 48 wherein the first and second wings have first and second edges extending between the first and second ends and wherein a curved indention is provided in the second edges of the first and second wings adjacent the second ends of the wings.

52. The marionette of claim 48 wherein the first and second wings have first and second edges extending between the first and second ends, wherein the first and second wings are connected together so that in an open position the second edge of the first wing is adjacent the second edge of the second wing and an angle between the second edge of the first wing and the second edge of the second wing is less than 90°.

53. The marionette of claim 48 wherein the first and second wings are pivotably connected together to enable the wings to move between an open position and a closed position and wherein the first wing is provided with nubs and the second wing has indents and wherein the nubs engage the indents to secure the wings in the open or closed position.

54. The marionette of claim 48 wherein the appendages are a pair of arms which are movably mounted on the body so that the pair of arms can rotate 360° about a horizontal axis through a shoulder of the puppet.

55. A controller for a marionette, which comprises:

(a) a first wing having a first end and a second end;

(b) a second wing having a first end and a second end and connected to the first wing so that the second end of the first wing is adjacent the second end of the second wing; and (c) a control rod having a first end and a second end, with the first end pivotably connected to the second end of the first and second wings and the second end having a connector with spaced apart prongs which are flexible so that the prongs compress together when inserted into an opening in a puppet of the marionette, wherein when the connector is fully in the opening in the puppet, the prongs spring back to an uncompressed position to lock the connector in the puppet.

56. The controller of claim 55 wherein the first and second wings have first and second edges extending between the first and second ends and wherein a curved indention is provided in the second edges of the first and second wings adjacent the second ends of the first and second wings.

57. The controller of claim 55 wherein the first and second wings have first and second edges extending between the first and second ends, wherein the first and second wings are connected together so that in an open position the second edge of the first wing is adjacent the second edge of the second wing and an angle between the second edge of the first wing and the second edge of the second wing is approximately less than 90°.

58. The controller of claim 55 wherein a hole is provided in each of the first ends of the first and second wings.

59. The controller of claim 55 wherein the first and second wings have first and second surfaces extending between the first and second ends and wherein the first and second wings are connected together such that the second surface of the first wing is adjacent the first surface of the second wing.

60. The controller of claim 59 the second end of the first wing has prongs which extend outward from the second surface of the first wing in a direction opposite the first surface of the first wing, wherein the second end of the second wing has curved slots around a perimeter of the second end of the second wing and wherein when the first and second wings are connected together, the prongs extend through the slots to secure the first and second wings together.

61. The controller of claim 59 wherein the first ends of the first and second wings have holes, wherein a curved indention is provided in the first surface of the first wing around the hole and in the first surface of the second wing around the hole, wherein a pair of control strings are provided having a first end and a second end with balls at each of the first and second ends, wherein the first end of the control strings are permanently connected to the first ends of the wings through the holes so that the balls at the first end of the control strings are movably positioned in the curved indentions on the first surface of the first and second wings and wherein the second ends of the control strings are connected to arms of the puppet.

62. The controller of claim 55 wherein the second ends of the first and second wings have a size greater than a size of the first ends of the first and second wings.

63. The controller of claim 55 wherein the control rod has an L-shape so that the second end of the control rod extends perpendicular to the first end of the control rod.

64. The controller of claim 55 wherein the first wing and the second wing are pivotably connected together to enable the wings to be moved between an open position and a closed position.

* * * * *